US005984278A

United States Patent [19]

Hartlmeier

[11] Patent Number: 5,984,278

[45] Date of Patent: Nov. 16, 1999

[54] SWIVEL POST LATCH SYSTEM FOR BEARING BLOCK

[75] Inventor: Greg Hartlmeier, Whitefish Bay, Wis.

[73] Assignee: Harken, Inc., Pewaukee, Ill.

[21] Appl. No.: 09/200,680

[22] Filed: Nov. 25, 1998

[51] Int. Cl.[6] ..... B66D 3/04

[52] U.S. Cl. ..... 254/415; 254/409; 294/82.15

[58] Field of Search ..... 254/415, 409, 254/401; 294/82.15, 86.41; 403/78, 164

[56] References Cited

U.S. PATENT DOCUMENTS 691,492 1/1902 Roney ..... 254/409
3,633,961 1/1972 Speransky et al. ..... 294/82.15
3,773,295 11/1973 Holmes ..... 254/409
4,669,907 6/1987 Patton ..... 403/78

FOREIGN PATENT DOCUMENTS 662030 4/1963 Canada ..... 294/82.15

*Primary Examiner*—Donald P. Walsh
*Assistant Examiner*—Minh-Chau Pham
*Attorney, Agent, or Firm*—Juettner Pyle & Piontek

[57] ABSTRACT

A bearing block has a head containing a totatably mounted post to enable attachment of the block on a support. A manually operated latch mechanism is mounted in the head, and the latch may be moved into engagement with one or more recesses in the post to lock the post in a given position.

9 Claims, 2 Drawing Sheets

SWIVEL POST LATCH SYSTEM FOR BEARING BLOCK

BACKGROUND OF THE INVENTION

Blocks or pulleys are used in a variety of application, including tackle systems and on sailing vessels to control and change direction of lines. A standard block or pulley includes a line receiving sheave rotatably mounted between a pair of cheeks or side plates, with the cheeks extending in one direction beyond the sheave to provide a head for attachment of the block to other objects, or a support.

In a block used as a yacht fitting, a swivel post extends outwardly from the head, and a shackle is attached in an opening through the swivel post. The swivel post is rotatably mounted in the head, in order to allow the block to rotate and accommodate a changing angle of a line. In other situations, the swivel post is fixed in position by use of a set screw in the head in engagement with the swivel post as shown in U.S. Pat. No. 3,528,645. The set screw may be engaged and disengaged as required, but this requires the use of a screwdriver and possible loss of the set screw.

There is a continuing need to provide simplification and convenience features on yacht fittings in order to improve operations and changes under sailing conditions without sacrifice of reliability.

SUMMARY OF THE INVENTION

In accordance with the present invention, a manual latch is provided in the head of a block, with the latch being movable into and out of locking engagement with corresponding surfaces, such as openings or detents, in the swivel post. The latch may be engaged with the post to lock the post against rotation, or the latch may be disengaged to permit free rotation of the post. The latch protrudes slightly from the head to allow for manual operation.

DESCRIPTION OF THE PREFERRED EMBODIMENTS

Figure 1:
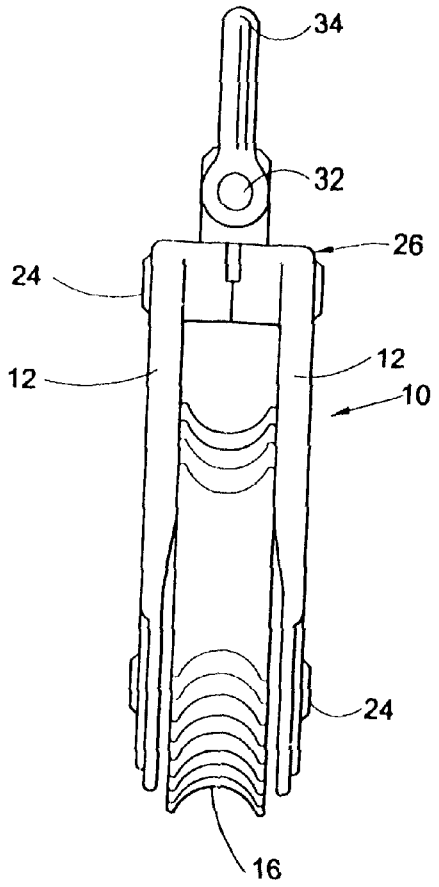
FIG. 1 is an end view of a bearing block incorporating features of the present invention.
Figure 2:
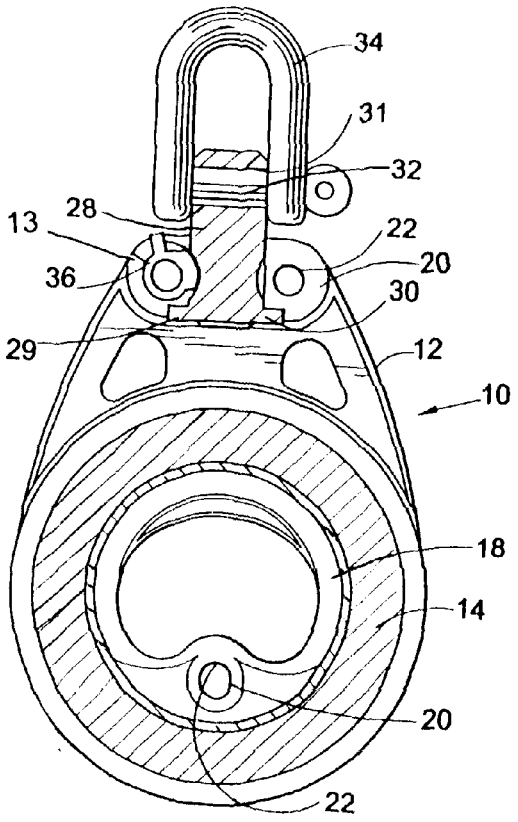
FIG. 2 is a partial cross sectional view through a bearing block perpendicular to the axis of rotation of the sheave, and showing features of the present invention.
Figure 3:
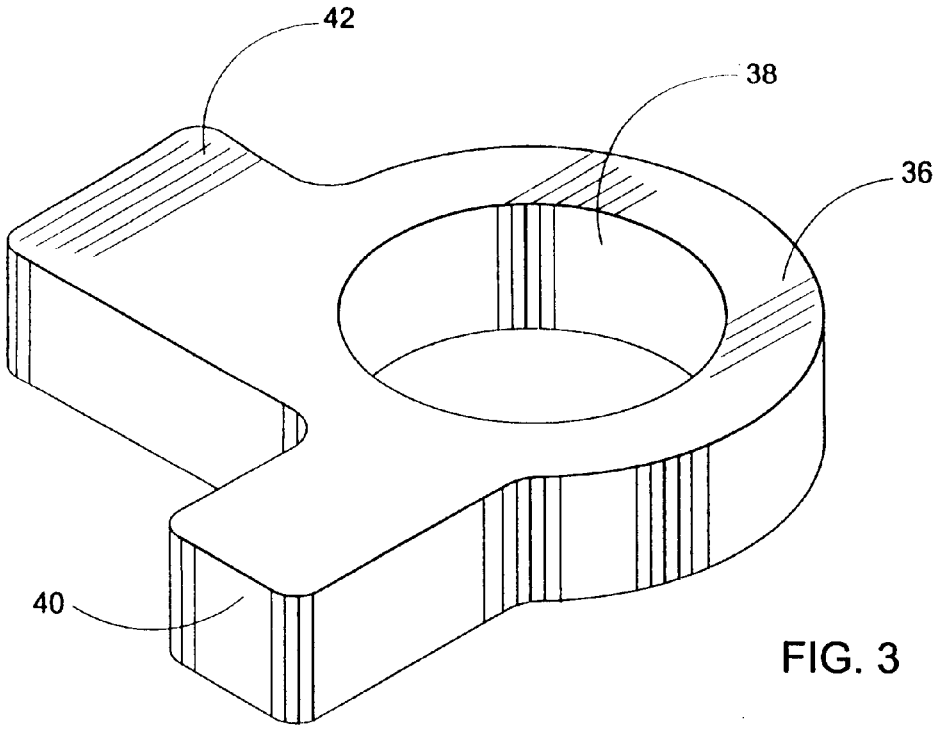
FIG. 3 is a perspective view of the latch of the present invention.
Figure 4:
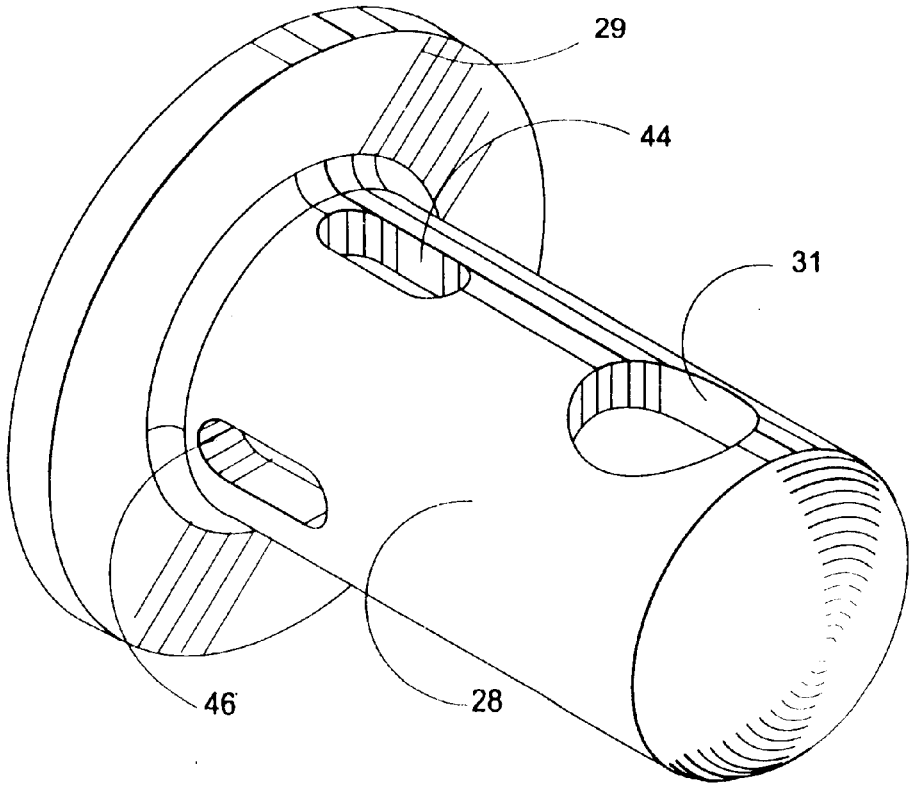
FIG. 4 is a perspective view of the swivel post used in connection with the present invention.

Since the features of a bearing block are well known to those skilled in the art, only a general description will be provided. The block 10 comprises a pair of spaced parallel cheeks or side plates 12, between which is rotatably mounted a circular sheave 14 having a grooved outer perimeter 16 for receiving a line. The cheeks 12 define an integral hub 18 around which the race of the ring shaped sheave 14 is disposed. Bearings, such as ball bearings (not shown) are disposed between the sheave and hub to reduce friction. Suitable bearing arrangements and other details are shown and described in U.S. Pat. No. 3,528,645 and U.S. Pat. No. 4,390,163, incorporated herein by reference. The cheeks include inwardly facing bosses 20 with openings 22 which receive fasteners such as bolts or rivets 24 to hold the cheeks together in a spaced relation.

As shown, a portion of the cheeks 12 extends beyond the sheave 14 to form an attachment head 26. A swivel post 28 has a lower and relatively disc-shaped end 29 which is rotatably mounted in a disc-shaped groove 30 within the head to allow rotation of the post around its longitudinal axis while preventing movement along the axis. The other end of the post 28 is provided with a transverse opening 31 to receive the attachment pin 32 of a conventional U-shaped shackle 34. Typically, the pin 32 has a threaded end and is removably threaded into a threaded opening in one of the arms of the shackle to allow removal and attachment of the shackle to a support, for example, the mast, boom or deck of a sailboat.

An internal recess 13 provided within the head 26 of the block to receive a rotary latch 36 having a central opening 38 such that the latch may be rotatably mounted on one of the rivets 24 which otherwise secure the block assembly together.

The latch 36 is in the shape of a ring and comprises a radially extending lever arm 40 and a locking lug 42 spaced approximately 45° inwardly of the arm. The lug 42 is movable by the lever 40 into and out of engagement with openings or recesses 44 and 46 in the swivel post 28. It will be noted that at least one recess 44 is in axial alignment with the upper opening 31, and at least one recess 46 is located at 45° relative to the first This allows the shackle 34 to be locked in at least two fixed positions relative to the plane of the sheave 14, depending on how the block is to be mounted. The lever 40 may be engaged by a finger and manually rotated away from the post to release the lug 42 and allow free rotation of the swivel post 28 about its axis in the head of the block.

It will be appreciated that additional recesses for the locking lug may be employed, and the swivel post may be solid or a hollow tube as shown. In the embodiment shown, the shackle may be located in two positions in which the plane of the shackle is either parallel or perpendicular to the plane of the sheave.

What is claimed is:

1. A swivel post latch system for a bearing block, said system comprising a bearing block, an attachment head on said bearing block, a swivel post, said swivel post having a longitudinal axis and being rotatable in said head about said axis, and a latch mechanism, said latch mechanism being manually movable into engagement with said swivel post to prevent rotation thereof, and said latch mechanism being manually movable out of engagement with said swivel post to allow rotation thereof; wherein said swivel post has a recess therein, and wherein said latch mechanism comprises a part engageable in said recess; and said latch mechanism additionally comprises a means for moving said part in and out of engagement with said recess.

2. The system of claim 1 wherein said means for moving said part comprises a lever associated with said latch mechanism.

3. The system of claim 1 wherein said latch mechanism comprises a unitary part rotatably mounted in said attachment, a locking lug on said part, and a lever on said part spaced from said locking lug.

4. A swivel post latch system for a bearing block, said system comprising a bearing block having a sheave rotatably mounted between two cheeks; an attachment head on said bearing block, a swivel post, said swivel post having a longitudinal axis and being rotatable in said head about said axis, said post having a top portion extending out of said head and a lower portion contained within said head; and a latch mechanism substantially contained within said head, said latch mechanism being manually movable into engagement with said swivel post lower portion to prevent rotation thereof, and said latch mechanism being manually movable out of engagement with said swivel post lower portion to allow rotation thereof.

5. The system of claim 4 further comprising a shackle connected to said swivel post for operatively connecting the block to a support; and wherein said latch mechanism is engageable and movable out of engagement with said swivel post while said shackle is operatively connected to a support.

6. A swivel post latch system as in claim 4, wherein said swivel post lower portion has a recess therein, and wherein said latch mechanism comprises a part engageable in said recess; and said latch mechanism additionally comprises a means for moving said part in and out of engagement with said recess.

7. The system of claim 6 wherein said means for moving said part comprises a lever associated with said latch mechanism.

8. The system of claim 7 wherein said latch mechanism comprises a unitary part rotatably mounted in said attachment, a locking lug on said part, and a lever on said part spaced from said locking lug.

9. A swivel post latch system for a bearing block, said system comprising a bearing block having a sheave rotatably mounted between two cheeks; an attachment head on said bearing block, a swivel post, said swivel post having a longitudinal axis and being rotatable in said head about said axis, said post having a top portion extending out of said head and a lower portion contained within said head having at least one recess; a shackle connected to said swivel post top portion for operatively connecting the block to a support; and a latch mechanism substantially contained within said head, said latch mechanism having a part manually movable into engagement with said swivel post lower portion recess to prevent rotation thereof, and said latch mechanism part being manually movable out of engagement with said swivel post lower portion to allow rotation thereof, said latch engageable and disengageable with said swivel post while said shackle operatively connected to a support, said latch mechanism having a lever for urging it into and out of engagement with said swivel post.

* * * * *